US005918848A

United States Patent [19]

Rini

[11] Patent Number: 5,918,848

[45] Date of Patent: Jul. 6, 1999

[54] DOCUMENT HOLDER AND TEXT GUIDE APPARATUS

[76] Inventor: Carol A. Rini, 1141 Grubstake Dr., Diamond Bar, Calif. 91765

[21] Appl. No.: 08/857,738

[22] Filed: May 16, 1997

[51] Int. Cl.[6] ..... B41J 11/62; A47B 19/00; A47B 5/04; A47B 23/04

[52] U.S. Cl. ..... 248/441.1; 248/447.1; 248/444.1; 400/718

[58] Field of Search ..... 248/441.1, 447.1, 248/453, 454, 455, 457, 460, 463; 400/718, 718.1, 718.2

[56] References Cited

U.S. PATENT DOCUMENTS

| | | | |
|---|---|---|---|
| 768,483 | 8/1904 | Rivers | 248/457 |
| 1,908,874 | 5/1933 | Van Alstine | 248/441.1 |
| 2,559,811 | 7/1951 | Warner et al. | 248/457 |
| 2,572,731 | 10/1951 | Keith | 248/457 |
| 3,763,989 | 10/1973 | Goldman | 197/181.2 |
| 4,317,565 | 3/1982 | Swette | 271/274 |
| 4,582,285 | 4/1986 | Bello | 248/442.2 |
| 4,693,443 | 9/1987 | Drain | 248/447.1 |
| 4,767,093 | 8/1988 | Jones | 248/442.2 |
| 4,894,756 | 1/1990 | Jan | 362/97 |
| 4,960,257 | 10/1990 | Waters | 248/442.2 |
| 5,161,767 | 11/1992 | Hansen | 248/447.1 |
| 5,288,050 | 2/1994 | Armstrong | 248/479 |
| 5,292,099 | 3/1994 | Isham et al. | 248/442.2 |
| 5,451,025 | 9/1995 | Hames | 248/457 |
| 5,499,793 | 3/1996 | Salansky | 248/442.2 |
| 5,621,927 | 4/1997 | Reiss et al. | 4/559 |
| 5,746,410 | 5/1998 | Hung | 248/441.1 |

FOREIGN PATENT DOCUMENTS

| | | | |
|---|---|---|---|
| 3317-709 | 11/1984 | Germany | 400/718.1 |
| 59-29184 | 2/1984 | Japan | 400/718.1 |
| 61-279572 | 12/1986 | Japan | 400/718 |
| 404109907 | 4/1992 | Japan | 248/441.1 |
| 404193204 | 7/1992 | Japan | 248/441.1 |
| 2 145 038 | 3/1985 | United Kingdom | 400/718 |

*Primary Examiner*—Leslie A. Braun
*Assistant Examiner*—Michael D. Nornberg

[57] ABSTRACT

A new document holder and text guide apparatus for indicating any line of text on a document. The inventive device includes a document support member with a planar surface for supporting a document. A lip extends from the document support member for resting a document. A shaft with external threads extends between the ends of the document support member. An indicating member designed for indicating a line of text on a document is mounted on the shaft to permit movement of the indicating member sleeve portion along the shaft when the shaft is rotated. The shaft is rotatable by a motor such that the indicating member is moved along the shaft when the shaft is rotated by the motor. The motor permits selective rotation of the shaft in both a clockwise and a counterclockwise direction for moving the indicating member towards either end of the shaft. A foot actuator is attached to the motor for selectively activating the motor and permitting selection of the direction the motor rotates the shaft. A supporting member supports the document support member upper end when the document support member is rested on a horizontal surface. To allow attachment of the invention to the side of a monitor, the invention includes an attachment member on either of its lateral sides.

1 Claim, 3 Drawing Sheets

FIG.3
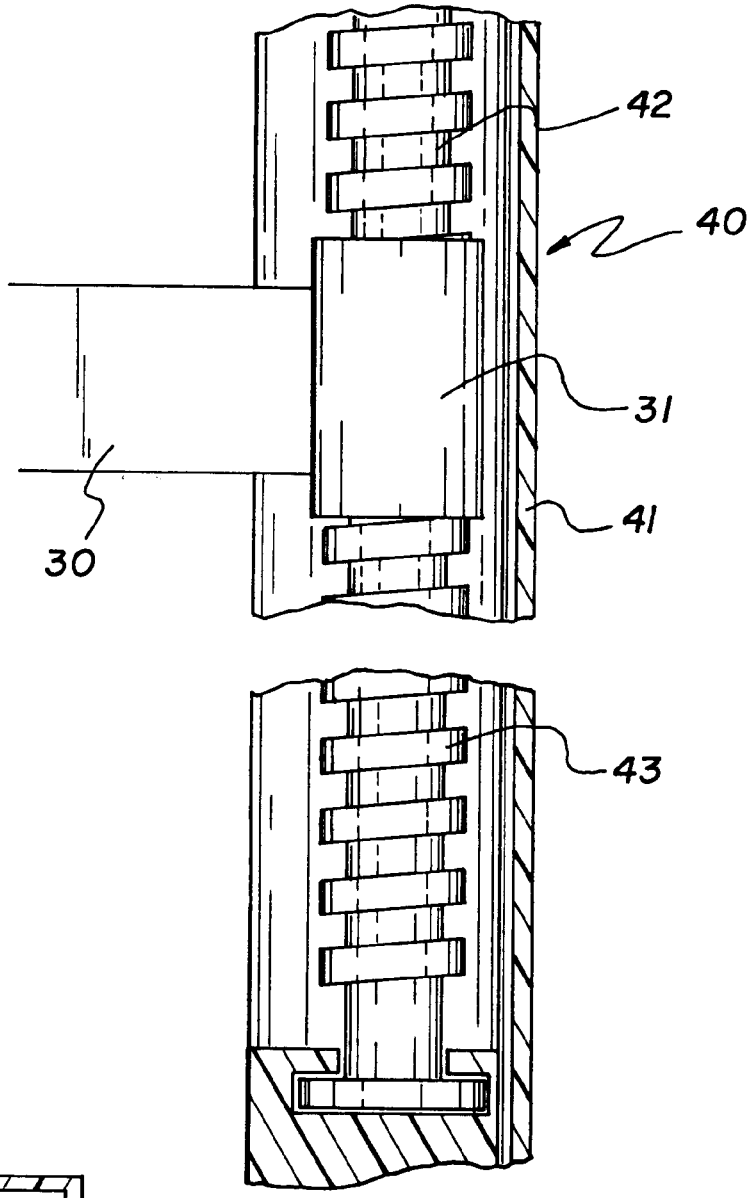
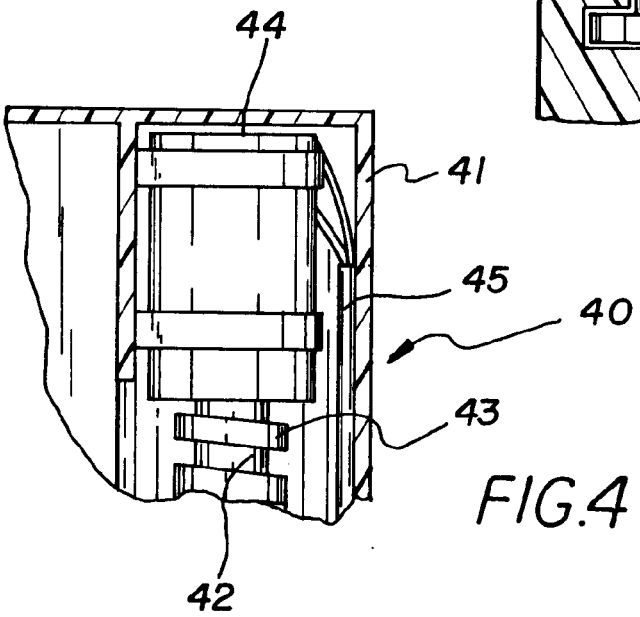
FIG.4

DOCUMENT HOLDER AND TEXT GUIDE APPARATUS

BACKGROUND OF THE INVENTION

1. Field of the Invention

The present invention relates to document holders and text guides and more particularly pertains to a new document holder and text guide apparatus for indicating any line of text on a document.

2. Description of the Prior Art

The use of document holders and text guides is known in the prior art. More specifically, document holders and text guides heretofore devised and utilized are known to consist basically of familiar, expected and obvious structural configurations, notwithstanding the myriad of designs encompassed by the crowded prior art which have been developed for the fulfillment of countless objectives and requirements.

Known prior art document holders and text guides include U.S. Pat. Nos. 5,213,508; 3,983,651; Des. 292,249; 5,290,002; 3,942,275; and 4,770,635.

While these devices fulfill their respective, particular objectives and requirements, the aforementioned patents do not disclose a new document holder and text guide apparatus. The inventive device includes a document support member with a planar surface for supporting a document. A lip extends from the document support member for resting a document. A shaft with external threads extends between the ends of the document support member. An indicating member designed for indicating a line of text on a document is mounted on the shaft to permit movement of the indicating member sleeve portion along the shaft when the shaft is rotated. The shaft is rotatable by a motor such that the indicating member is moved along the shaft when the shaft is rotated by the motor. The motor permits selective rotation of the shaft in both a clockwise and a counterclockwise direction for moving the indicating member towards either end of the shaft. A foot actuator is attached to the motor for selectively activating the motor and permitting selection of the direction the motor rotates the shaft. A supporting member supports the document support member upper end when the document support member is rested on a horizontal surface. To allow attachment of the invention to the side of a monitor, the invention includes an attachment member on either of its lateral sides.

In these respects, the document holder and text guide apparatus according to the present invention substantially departs from the conventional concepts and designs of the prior art, and in so doing provides an apparatus primarily developed for the purpose of indicating any line of text on a document and typing text without moving one's hands off the keyboard to move the indicating member down the document to the next line of text.

SUMMARY OF THE INVENTION

In view of the foregoing disadvantages inherent in the known types of document holders and text guides now present in the prior art, the present invention provides a new document holder and text guide apparatus construction wherein the same can be utilized for indicating any line of text on a document.

The general purpose of the present invention, which will be described subsequently in greater detail, is to provide a new document holder and text guide apparatus and method which has many of the advantages of the document holders and text guides mentioned heretofore and many novel features that result in a new document holder and text guide apparatus which is not anticipated, rendered obvious, suggested, or even implied by any of the prior art document holders and text guides, either alone or in any combination thereof.

To attain this, the present invention generally comprises a document support member with a planar surface for supporting a document. A lip extends from the document support member for resting a document. A shaft with external threads extends between the ends of the document support member. An indicating member designed for indicating a line of text on a document is mounted on the shaft to permit movement of the indicating member sleeve portion along the shaft when the shaft is rotated. The shaft is rotatable by a motor such that the indicating member is moved along the shaft when the shaft is rotated by the motor. The motor permits selective rotation of the shaft in both a clockwise and a counterclockwise direction for moving the indicating member towards either end of the shaft. A foot actuator is attached to the motor for selectively activating the motor and permitting selection of the direction the motor rotates the shaft. A supporting member supports the document support member upper end when the document support member is rested on a horizontal surface. To allow attachment of the invention to the side of a monitor, the invention includes an attachment member on either of its lateral sides.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new document holder and text guide apparatus and method which has many of the advantages of the document holders and text guides mentioned heretofore and many novel features that result in a new document holder and text guide apparatus which is not anticipated, rendered obvious, suggested, or even implied by any of the prior art document holders and text guides, either alone or in any combination thereof.

It is another object of the present invention to provide a new document holder and text guide apparatus which may be easily and efficiently manufactured and marketed.

It is a further object of the present invention to provide a new document holder and text guide apparatus which is of a durable and reliable construction.

An even further object of the present invention is to provide a new document holder and text guide apparatus which is susceptible of a low cost of manufacture with regard to both materials and labor, and which accordingly is then susceptible of low prices of sale to the consuming public, thereby making such document holder and text guide apparatus economically available to the buying public.

Still yet another object of the present invention is to provide a new document holder and text guide apparatus which provides in the apparatuses and methods of the prior art some of the advantages thereof, while simultaneously overcoming some of the disadvantages normally associated therewith.

Still another object of the present invention is to provide a new document holder and text guide apparatus for indicating any line of text on a document.

Yet another object of the present invention is to provide a new document holder and text guide apparatus which includes a document support member with a planar surface for supporting a document. A lip extends from the document support member for resting a document. A shaft with external threads extends between the ends of the document support member. An indicating member designed for indicating a line of text on a document is mounted on the shaft to permit movement of the indicating member sleeve portion along the shaft when the shaft is rotated. The shaft is rotatable by a motor such that the indicating member is moved along the shaft when the shaft is rotated by the motor. The motor permits selective rotation of the shaft in both a clockwise and a counterclockwise direction for moving the indicating member towards either end of the shaft. A foot actuator is attached to the motor for selectively activating the motor and permitting selection of the direction the motor rotates the shaft. A supporting member supports the document support member upper end when the document support member is rested on a horizontal surface. To allow attachment of the invention to the side of a monitor, the invention includes an attachment member on either of its lateral sides.

Still yet another object of the present invention is to provide a new document holder and text guide apparatus that allows hands-free movement of a line guide along a document.

Even still another object of the present invention is to provide a new document holder and text guide apparatus that is mountable to a monitor when desk space is limited.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a partial cross-sectional view of the means for moving the indicating member along the document support member taken from line 3—3 of FIG. 2.

FIG. 4 is a partial cross sectional view of the motor that rotates the shaft taken from line 4—4 of FIG. 2.

DESCRIPTION OF THE PREFERRED EMBODIMENT

Figure 1:
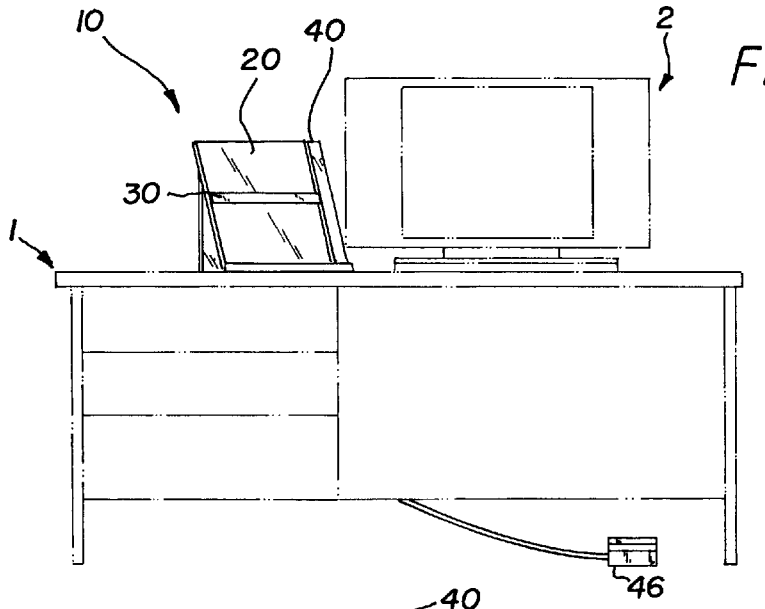
FIG. 1 is a side view of a new document holder and text guide apparatus resting on a desk according to the present invention.
Figure 2:
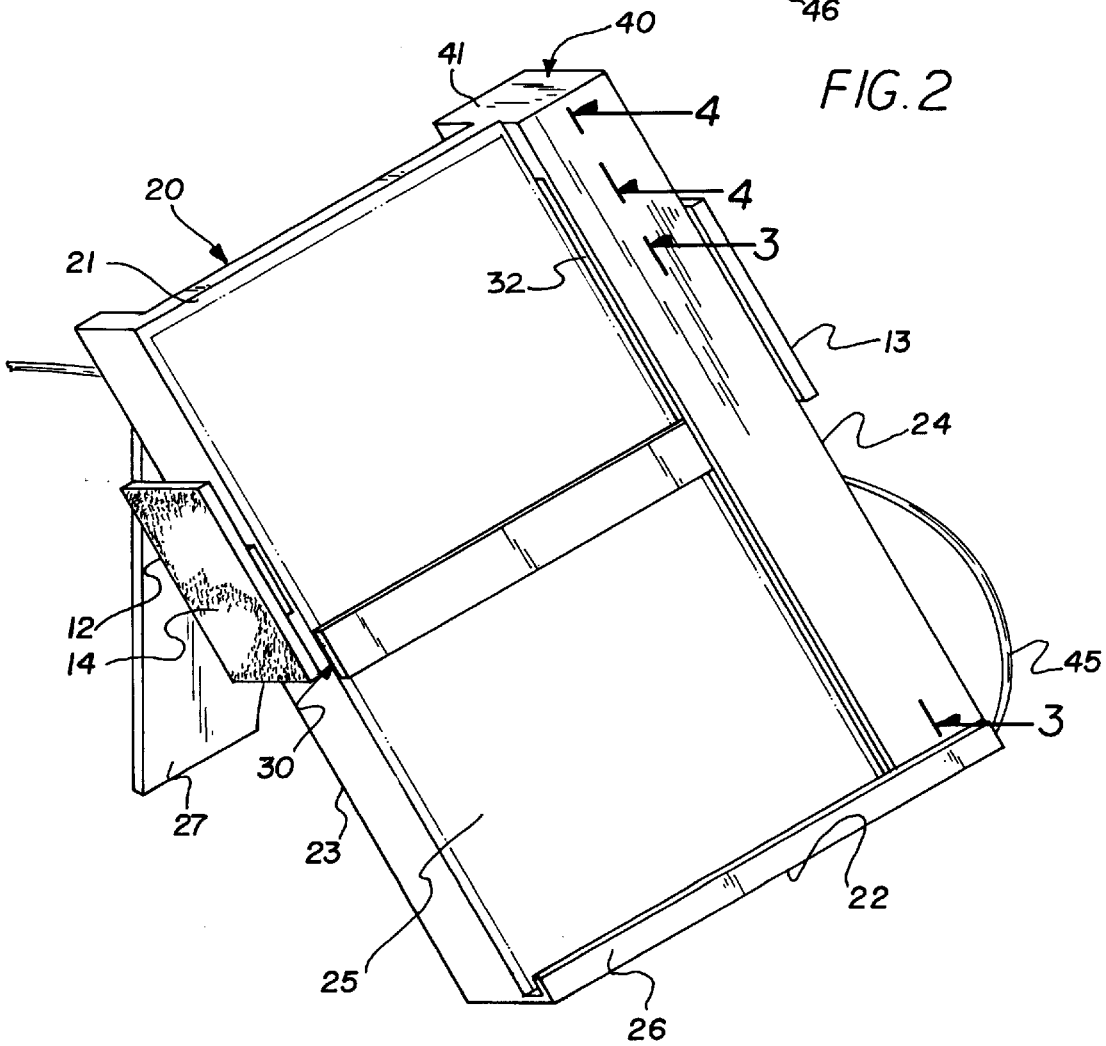
FIG. 2 is a perspective view of the present invention.
Figure 5:
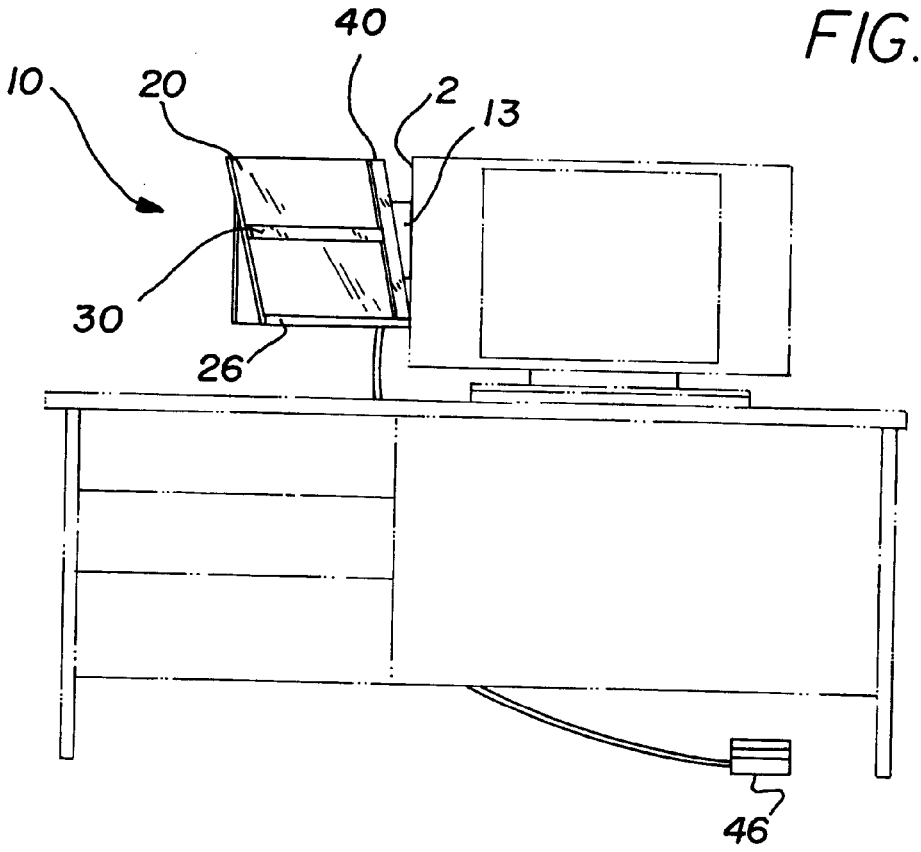
FIG. 5 is a side view of the present invention attached the a vertical side of a video display monitor.

With reference now to the drawings, and in particular to FIGS. 1 through 5 thereof, a new document holder and text guide apparatus embodying the principles and concepts of the present invention and generally designated by the reference numeral 10 will be described.

As best illustrated in FIGS. 1 through 5, the document holder and text guide apparatus 10 includes a document support member 20 having an upper end 21, a lower end 22, a pair of lateral sides 23,24, and a substantially planar surface 25 for supporting a document. Preferably, the planar surface 25 is of sufficient size to support of a documents on legal length sized paper. Extending from the lower end 22 is a lip 26 for resting a document.

The invention also includes a means for supporting the document support member 20 on a horizontal surface such as a desk so that the upper end 21 is raised above the lower end 22. Preferably, this is achieved by a supporting member 27 depending downwards from the document support member 20 so that it supports the upper end when the invention rests on a desktop 1.

Attached to either side 23,24 of the document support member 20 is an attachment member 12,13. Preferably, the attachment members are pivotally attached to the sides 23,24 of the document support member 20. This permits adjustment of the position of the document support member 20 in relation to the vertical surface 2.

The attachment members 12,13 provide a means for supporting the document support member to a substantially vertical surface such as the side of a computer monitor 2. Ideally, the attachment members 12,13 each have an attachment surface 14 that is attachable to the vertical surface 2. Even more preferably, this surface 14 has a portion of a hook and loop fastener which can be detachably attached to a corresponding hook and loop portion attached to the monitor 2.

Extending across the planar surface 25 is an elongate indicating member 30. The indicating member 30 helps indicate a particular line of text on a document. The indicating member 30 also helps to hold a document against the document support member 20 when in use.

Preferably, the document holder and text guide apparatus 10 also includes a means for selectively positioning the indicating member 30 along the document support member 20 so that the indicating member 30 can be moved to indicate different lines of text on a document. Most preferably, the indicating member 30 can be selectively moved both up and down along the length of the document support member 20.

Ideally, this selective positioning means 40 is contained within a housing 41 located at one side 24 of the document support member 20. Within the housing 41 is a shaft 42 having external threads 43. The shaft 42 extends between the document support member upper end 21 and the document support member bottom end 22.

A sleeve portion 31 formed at one end of the indicating member 30 is mounted on to the shaft 42. The sleeve portion 31 has internal threads (not shown) that cooperatively engage the external threads 43 of the shaft 42 so that when the shaft 42 is rotated, the sleeve portion 31 moves along the shaft 42. Preferably, the rest of the indicating member extends from the shaft 42 through a slot 32 in the housing 41 across the planar surface 25 of the document support member 20.

Preferably, the shaft 42 is rotated by a motor 44. More preferably, the motor 44 is designed to allow selective rotation of the shaft 42 in both a clockwise and a counterclockwise direction. This allows the sleeve portion 31 of the indicating member 30 to move towards either end of the shaft 42 depending on the direction of the rotation of the shaft 42.

The motor 44 is controlled by controller 45. Preferably, the controller 45 includes a foot actuator 46 that permits selective activation of the motor 44. The foot actuator 46 also permits selection of the direction that the motor 44 rotates the shaft 42.

In use, the document holder and text guide apparatus 10 can rest on the surface of a desk 1 or be attached by one of the attachment member 12,13 to a side of a monitor 2. The location of the attachment members 12,13 on either side of the document support member 20 allows attachment of the invention to either side of the monitor 2. The foot actuator 46 allows a user to selectively control the position of the indicating member 30 between the ends 21,22 of the document support member 20 so that a user can indicate different lines of text on a document.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A document holder and text guide apparatus for holding a document having lines of text thereon, comprising:

a document support member having an upper end, a lower end, a pair of lateral sides, and a substantially planar surface for supporting a document thereon;

a lip extending from said document support member for resting a document thereon and including a substantially planar rectangular inboard portion and a substantially planar rectangular outboard portion coupled to said inboard portion and extending upwardly therefrom in perpendicular relationship therewith and in parallel relationship with said document support member;

a shaft having external threads and being extended between said document support member upper end and said document support member bottom end;

wherein said shaft is positioned within a housing integrally formed along one of said lateral sides of said document support member and protruding forwardly from said planar surface for defining a front face and an inner face;

wherein said shaft has a bottom end with an annular flange coupled thereto for being rotatable within an annular recess formed in a bottom face of the housing;

an elongate indicating member having a sleeve portion being formed at one end, said indicating member for indicating a line of text on a document, wherein said indicating member remains in a plane including an axis of said sleeve portion, said sleeve portion having internal threads, said indicating member sleeve portion being mounted on said shaft, said internal threads cooperatively engaging said shaft external threads to permit movement of said indicating member sleeve portion along said shaft when said shaft is rotated, wherein said indicating member extends from a slot formed in said inner face of said housing;

a motor positioned with said housing, said shaft being rotatable by said motor such that said indicating member sleeve portion is moved along said shaft when said shaft is rotated by said motor, said motor permitting selective rotation of said shaft in both a clockwise and a counterclockwise direction for moving said indicating member sleeve portion towards either end of said shaft;

a foot actuator for selectively activating said motor and permitting selection of the direction said motor rotates said shaft;

a supporting member being downwardly depended from said document support member, said supporting member being for supporting said document support member upper end above a substantially horizontal surface; and an attachment member having an attachment surface and being pivotally attached to a rearwardly extending side wall mounted on one of said lateral sides of said document support member, said attachment surface being for attachment to a substantially vertical surface.

* * * * *